US011496853B2

(12) United States Patent
Kobayashi et al.

(10) Patent No.: US 11,496,853 B2
(45) Date of Patent: Nov. 8, 2022

(54) SOUND SIGNAL PROCESSING DEVICE AND SOUND SIGNAL PROCESSING METHOD

(71) Applicant: SOCIONEXT INC., Kanagawa (JP)

(72) Inventors: Kai Kobayashi, Yokohama (JP); Takeshi Fujita, Yokohama (JP); Shuji Miyasaka, Yokohama (JP)

(73) Assignee: SOCIONEXT INC., Kanagawa (JP)

( * ) Notice: Subject to any disclaimer, the term of this patent is extended or adjusted under 35 U.S.C. 154(b) by 0 days.

(21) Appl. No.: 17/377,010

(22) Filed: Jul. 15, 2021

(65) Prior Publication Data

US 2022/0046377 A1 Feb. 10, 2022

(30) Foreign Application Priority Data

Aug. 7, 2020 (JP) ..... JP2020-134704

(51) Int. Cl.

| | |
|---|---|
| ***H04R 5/02*** | (2006.01) |
| ***H04S 7/00*** | (2006.01) |
| ***H04S 1/00*** | (2006.01) |
| ***H04R 3/04*** | (2006.01) |
| ***H04R 5/04*** | (2006.01) |
| ***H04R 3/12*** | (2006.01) |

(52) U.S. Cl.

CPC ..... *H04S 7/307* (2013.01); *H04R 3/04* (2013.01); *H04R 3/12* (2013.01); *H04R 5/04* (2013.01); *H04S 1/002* (2013.01); *H04S 2420/13* (2013.01)

(58) Field of Classification Search

CPC ..... H04S 7/307; H04S 1/002; H04S 2420/13; H04R 3/04; H04R 3/12; H04R 5/04

USPC ..... 381/300

See application file for complete search history.

(56) References Cited

FOREIGN PATENT DOCUMENTS

| | | | |
|---|---|---|---|
| JP | 09084198 A | * | 3/1997 |
| JP | H09-084198 A | | 3/1997 |

* cited by examiner

*Primary Examiner* — Ammar T Hamid

(74) *Attorney, Agent, or Firm* — McDermoti Will & Emery LLP

(57) ABSTRACT

A sound signal processing device includes: a vocal remover which generates a first output signal based on first-channel and second-channel sound signals and a first coefficient indicating a vocal bandwidth to be removed; a surround sound processor which generates a second output signal by adding a surround sound effect to the first output signal; an amplifier which amplifies a signal at an amplification factor that is based on a second coefficient; a synthesizer which synthesizes the second output signal with one of the first-channel and second-channel sound signals, and synthesizes a signal that is the second output signal inverted with another one of the first-channel and second-channel sound signals; and a coefficient determination unit which sets the second coefficient such that the amplification factor, used when the vocal bandwidth to be removed is greater than a first bandwidth, is greater than the amplification factor for the first bandwidth.

11 Claims, 8 Drawing Sheets

FIG. 5 surround sound perception

×1 : Too strong, △1 : Strong,
○ : Good, △2 : Weak,
×2 : Not perceived

| Gain value [dB] | 200 | 300 | 400 | 500 | 800 | 1000 | 1500 | 2000 | 2500 | 3000 | 4000 |
|---|---|---|---|---|---|---|---|---|---|---|---|
| 6 | ×1 | ×1 | ×1 | ×1 | △1 | △1 | △1 | ○ | ○ | ○ | △2 |
| 5 | ×1 | ×1 | △1 | △1 | △1 | △1 | ○ | ○ | ○ | ○ | △2 |
| 4 | △1 | △1 | △1 | △1 | △1 | ○ | ○ | ○ | △2 | △2 | △2 |
| 3 | △1 | △1 | △1 | △1 | ○ | ○ | △2 | △2 | △2 | △2 | ×2 |
| 2 | ○ | ○ | ○ | ○ | ○ | ○ | △2 | △2 | △2 | ×2 | ×2 |
| 1 | ○ | ○ | ○ | ○ | ○ | △2 | △2 | △2 | ×2 | ×2 | ×2 |
| 0 | ○ | ○ | ○ | ○ | ○ | △2 | ×2 | ×2 | ×2 | ×2 | ×2 |
| -1 | ○ | ○ | ○ | △2 | △2 | △2 | ×2 | ×2 | ×2 | ×2 | ×2 |
| -2 | ○ | ○ | △2 | △2 | △2 | ×2 | ×2 | ×2 | ×2 | ×2 | ×2 |
| -3 | △2 | △2 | △2 | △2 | ×2 | ×2 | ×2 | ×2 | ×2 | ×2 | ×2 |
| -4 | △2 | △2 | △2 | △2 | ×2 | ×2 | ×2 | ×2 | ×2 | ×2 | ×2 |
| -5 | △2 | △2 | △2 | △2 | ×2 | ×2 | ×2 | ×2 | ×2 | ×2 | ×2 |

HPF Fc [Hz]

FIG. 6

Vocal clarity

○ : Clear
△ : Vague
× : Unclear

| Gain value [dB] | 200 | 300 | 400 | 500 | 800 | 1000 | 1500 | 2000 | 2500 | 3000 | 4000 |
|---|---|---|---|---|---|---|---|---|---|---|---|
| 6 | × | × | × | × | × | △ | ○ | ○ | ○ | ○ | ○ |
| 5 | × | × | × | × | △ | ○ | ○ | ○ | ○ | ○ | ○ |
| 4 | × | × | × | △ | ○ | ○ | ○ | ○ | ○ | ○ | ○ |
| 3 | × | × | △ | ○ | ○ | ○ | ○ | ○ | ○ | ○ | ○ |
| 2 | × | △ | △ | ○ | ○ | ○ | ○ | ○ | ○ | ○ | ○ |
| 1 | △ | △ | ○ | ○ | ○ | ○ | ○ | ○ | ○ | ○ | ○ |
| 0 | △ | △ | ○ | ○ | ○ | ○ | ○ | ○ | ○ | ○ | ○ |
| -1 | △ | ○ | ○ | ○ | ○ | ○ | ○ | ○ | ○ | ○ | ○ |
| -2 | ○ | ○ | ○ | ○ | ○ | ○ | ○ | ○ | ○ | ○ | ○ |
| -3 | ○ | ○ | ○ | ○ | ○ | ○ | ○ | ○ | ○ | ○ | ○ |
| -4 | ○ | ○ | ○ | ○ | ○ | ○ | ○ | ○ | ○ | ○ | ○ |
| -5 | ○ | ○ | ○ | ○ | ○ | ○ | ○ | ○ | ○ | ○ | ○ |

HPF Fc [Hz]

SOUND SIGNAL PROCESSING DEVICE AND SOUND SIGNAL PROCESSING METHOD

CROSS REFERENCE TO RELATED APPLICATION

The present application is based on and claims priority of Japanese Patent Application No. 2020-134704 filed on Aug. 7, 2020. The entire disclosure of the above-identified application, including the specification, drawings and claims is incorporated herein by reference in its entirety.

FIELD

The present disclosure relates to a sound signal processing device and a sound signal processing method.

BACKGROUND

A technique is conventionally known which adds surround sound effects to a sound signal in order to provide stereophonic perception or depth perception to sound when reproducing the sound signal. Moreover, it is preferred that the sound signal on which a surround signal process is performed for adding the surround sound effects does not include vocal components (voice components) such as dialog or lyrics. Patent Literature (PTL) 1 discloses a sound signal processing device which performs a surround signal process on a sound signal from which vocal components have been removed with use of a band elimination filter.

CITATION LIST

PTL 1: Japanese Unexamined Patent Application Publication No. H09-084198

SUMMARY

Technical Problem

However, the technique described in PTL 1 may fail to add surround sound effects appropriately.

In view of the above, a sound signal processing device and the like is provided which is capable of appropriately adding surround sound effects.

Solution to Problem

A sound signal processing device according to one aspect of the present disclosure includes: a remover which generates a first output signal based on a first-channel sound signal, a second-channel sound signal, and a first coefficient indicating a vocal bandwidth to be removed, the first output signal being a signal from which a vocal component has been removed; a surround sound processor which generates a second output signal by adding a surround sound effect to the first output signal; an amplifier which amplifies an input signal at an amplification factor that is based on a second coefficient, the amplifier being (i) connected upstream of the remover, (ii) connected between the remover and the surround sound processor, (iii) included in the remover, or (iv) included in the surround sound processor; a first synthesizer which synthesizes the second output signal with one of the first-channel sound signal and the second-channel sound signal; a second synthesizer which synthesizes a signal that is the second output signal inverted with another one of the first-channel sound signal and the second-channel sound signal; and a setting unit which sets the first coefficient and the second coefficient. The setting unit sets the second coefficient such that the amplification factor used when the vocal bandwidth to be removed based on the first coefficient is a second bandwidth is greater than the amplification factor used when the vocal bandwidth to be removed based on the first coefficient is a first bandwidth, the second bandwidth being greater than the first bandwidth.

A sound signal processing method according to one aspect of the present disclosure includes: generating a first output signal based on a first-channel sound signal, a second-channel sound signal, and a first coefficient indicating a vocal bandwidth to be removed, the first output signal being a signal from which a vocal component has been removed; generating a second output signal by adding a surround sound effect to the first output signal; amplifying an input signal at an amplification factor that is based on a second coefficient, the amplifying being performed (i) before the generating of the first output signal, (ii) between the generating of the first output signal and the generating of the second output signal, (iii) as part of the generating of the first output signal, or (iv) as part of the generating of the second output signal; synthesizing the second output signal with one of the first-channel sound signal and the second-channel sound signal; synthesizing a signal that is the second output signal inverted with another one of the first-channel sound signal and the second-channel sound signal; and setting the first coefficient and the second coefficient. The setting includes setting the second coefficient such that the amplification factor used when the vocal bandwidth to be removed based on the first coefficient is a second bandwidth is greater than the amplification factor used when the vocal bandwidth to be removed based on the first coefficient is a first bandwidth, the second bandwidth being greater than the first bandwidth.

Advantageous Effects

A sound signal processing device and the like according to one aspect of the present disclosure is capable of appropriately adding surround sound effects.

BRIEF DESCRIPTION OF DRAWINGS

These and other advantages and features will become apparent from the following description thereof taken in conjunction with the accompanying Drawings, by way of non-limiting examples of embodiments disclosed herein.

FIG. 5 illustrates results of sensory experiments on surround sound perception according to Embodiment 1.

FIG. 6 illustrates results of sensory experiments on vocal clarity according to Embodiment 1.

DESCRIPTION OF EMBODIMENTS

Circumstances Leading to Present Disclosure

Figure 1:
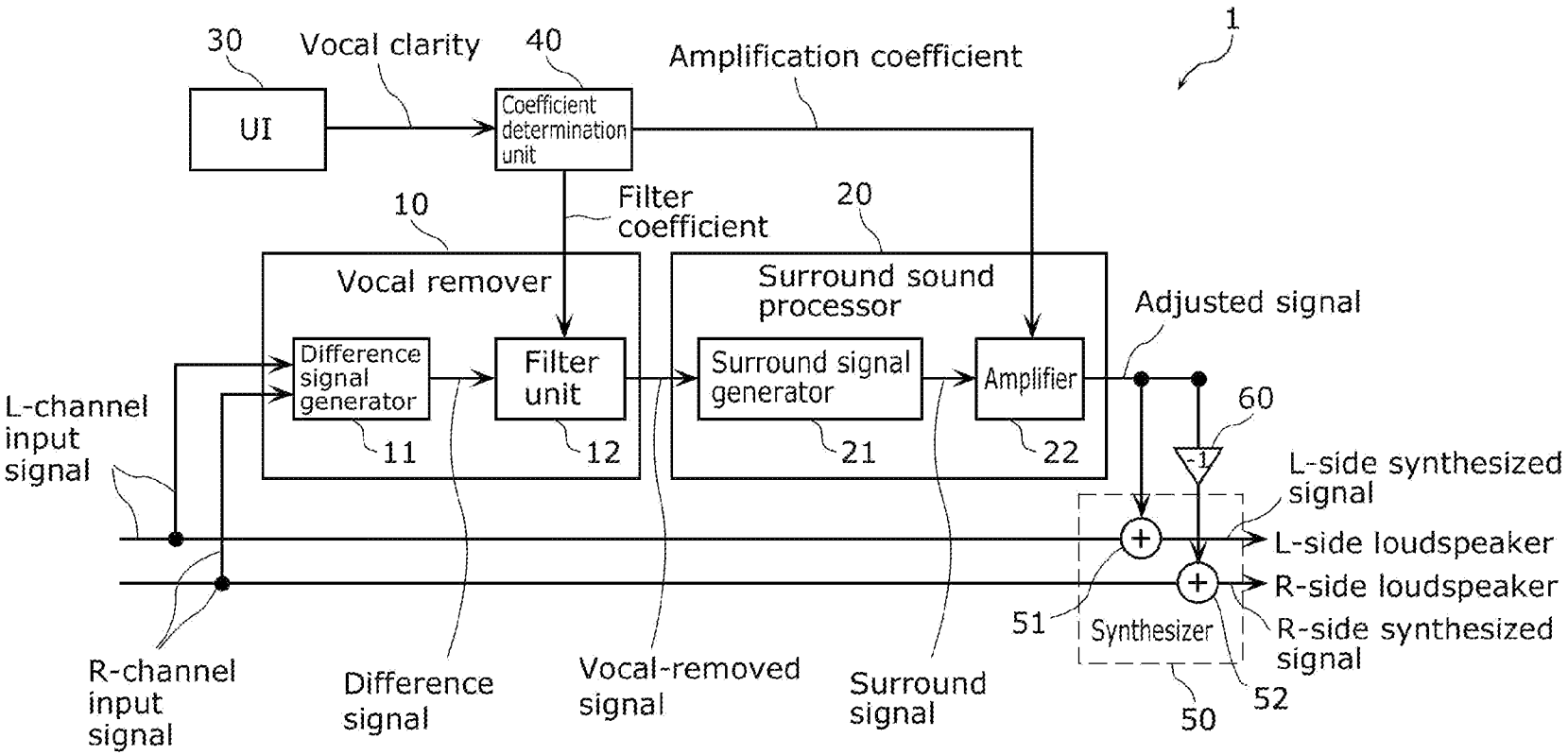
FIG. 1 is a block diagram illustrating a functional configuration of a sound signal processing device according to Embodiment 1.

Prior to describing embodiments of the present disclosure, circumstances leading to the basic of the present disclosure will be described.

In the technique disclosed in PTL 1, vocal components are removed from an addition signal in which an L-channel sound signal and an R-channel sound signal are added, by using a band elimination filter. In the case where the band elimination filter includes a low-pass filter (LPF) and a high-pass filer (HPF), the vocal components can be removed from the addition signal by setting the cutoff frequencies of the LPF and the HPF to the frequencies which allow removal of the vocal components. The L-channel sound signal is a sound signal input to an L-side loudspeaker, and the R-channel sound signal is a sound signal input to an R-side loudspeaker. The L-side loudspeaker and the R-side loudspeaker are loudspeakers arranged at different positions in the same space. For example, the L-side loudspeaker is arranged to the left of a reference position, and the R-side loudspeaker is arranged to the right of the reference position.

When a surround signal process for adding surround sound effects is performed on an addition signal including vocal components, stereophonic perception and the like is added to the vocal components, too. As a result, unclear (for example, unsharp) voice may be output, reducing the realistic sensation or making the user feel strange. Hence, before the surround signal process is performed, the process of removing the vocal components is performed as described above.

Here, the addition signal which has passed the LPF and HPF becomes a sound signal from which the vocal components and components other than the vocal components with the same frequency bandwidth as the vocal components have been removed. When the cutoff frequency of the LPF is reduced and the cutoff frequency of the HPF is increased to more reliably remove the vocal components, the removal amount of the components other than the vocal components increases. Accordingly, the intensity (absolute amount) of the addition signal on which the surround signal process is performed can be significantly lower than the addition signal before passing the LPF and the HPF. Even if the surround signal process is performed on such an addition signal and the signal is synthesized with the L-channel sound signal and the R-channel sound signal, the intensity of the processed addition signal is lower than the L-channel sound signal and the R-channel sound signal. Hence, the surround sound effects to be added is also small. In other words, the technique disclosed in PTL 1 is unlikely to appropriately add the surround sound effects.

The components other than the vocal components are, for example, sound components, such as sound effects, performance sound, background sound (that is, background music (BGM)), which do not include voice.

Moreover, when the cutoff frequency of the LPF is set to increase and the cutoff frequency of the HPF is set to decrease to prevent the intensity of the addition signal from being reduced, the vocal components are unlikely to be removed. As a result, voice is heard unclearly. As described above, the technique disclosed in PTL 1 is unlikely to appropriately add the surround sound effects and prevent unclear voice.

In view of the above, the inventors of the present application have intensively studied a sound signal processing device and the like which is capable of appropriately adding surround sound effects to an L-channel sound signal and an R-channel sound signal, and also preventing voice from becoming unclear while appropriately adding surround sound effects. As a result, the inventors have arrived at the sound signal processing device and the like to be described below.

A sound signal processing device according to one aspect of the present disclosure includes: a remover which generates a first output signal based on a first-channel sound signal, a second-channel sound signal, and a first coefficient indicating a vocal bandwidth to be removed, the first output signal being a signal from which a vocal component has been removed; a surround sound processor which generates a second output signal by adding a surround sound effect to the first output signal; an amplifier which amplifies an input signal at an amplification factor that is based on a second coefficient, the amplifier being (i) connected upstream of the remover, (ii) connected between the remover and the surround sound processor, (iii) included in the remover, or (iv) included in the surround sound processor; a first synthesizer which synthesizes the second output signal with one of the first-channel sound signal and the second-channel sound signal; a second synthesizer which synthesizes a signal that is the second output signal inverted with another one of the first-channel sound signal and the second-channel sound signal; and a setting unit which sets the first coefficient and the second coefficient. The setting unit sets the second coefficient such that the amplification factor used when the vocal bandwidth to be removed based on the first coefficient is a second bandwidth is greater than the amplification factor used when the vocal bandwidth to be removed based on the first coefficient is a first bandwidth, the second bandwidth being greater than the first bandwidth.

With the above aspect, in the sound signal processing device, the amplification factor of the amplifier is increased when the vocal bandwidth to be removed is increased and the intensity of the first output signal is reduced. Accordingly, the sound signal processing device is capable of preventing the intensity of the second output signal from being reduced. In other words, the sound signal processing device is capable of preventing the intensity of the second output signal from being reduced relative to the first-channel sound signal and the second-channel sound signal. Hence, it is possible to prevent the surround sound effects of the synthesized signal from being reduced. Accordingly, compared with the case where the amplification factor of the amplifier does not change even when the vocal bandwidth to be removed is increased, the sound signal processing device is capable of appropriately adding surround sound effects.

Moreover, it may be that the setting unit sets the first coefficient and the second coefficient according to a vocal clarity which indicates a level of clarity of voice that is based on synthesized signals generated by the first synthesizer and the second synthesizer.

With the above aspect, the sound signal processing device is capable of generating a signal which provides voice with desired vocal clarity.

Moreover, for example, it may be that the remover includes a high-pass filter, and the setting unit sets the first coefficient such that a cutoff frequency of the high-pass filter increases as the vocal clarity increases, and sets the second coefficient such that the amplification factor increases as the vocal clarity increases. Moreover, for example, it may be that the remover includes a high-pass filter, the vocal clarity is represented by a monotonically increasing graph indicating a cutoff frequency of the high-pass filter on a horizontal axis and the amplification factor of the amplifier on a vertical axis, and the setting unit sets the first coefficient and the second coefficient based on the vocal clarity and the monotonically increasing graph.

With the above aspects, the second coefficient is set such that a change in surround sound effects due to a change in the first coefficient is reduced. Hence, the sound signal processing device is capable of generating a signal which provides voice that is in accordance with the vocal clarity, while reducing a change in surround sound effects.

Moreover, for example, it may be that the monotonically increasing graph is a logarithmic graph.

With the above aspect, the change range of the clarity of the voice to be output relative to the change range of the vocal clarity can be equalized.

Moreover, for example, it may be that the monotonically increasing graph is a straight line graph.

With the above aspect, when the cutoff frequency of the filter unit (for example, filter unit including a high-pass filter) is set to the high-frequency range (for example, 2000 Hz or higher) and the removal amount of the signal components in the high-frequency range is less than the removal amount of the signal components in the low-frequency range, the sound signal processing device is capable of further increasing the surround sound effects. Moreover, since the first coefficient and the second coefficient can be set by a simpler calculation, the processing amount in the sound signal processing device can be reduced.

Moreover, for example, it may be that a user interface for receiving an input of the vocal clarity from a user is further included.

With the above aspect, the sound signal processing device is capable of further generating a signal which provides voice with vocal clarity designated by the user.

Moreover, for example, it may be that the setting unit further sets the second coefficient according to a surround sound perception indicating a user preference for an addition of the surround sound effect.

With the above aspect, since the sound signal processing device changes the amplification factor of the amplifier according to the surround sound perception, the sound signal processing device is capable of further generating a signal which provides sound that is in accordance with the surround sound perception. In other words, the sound signal processing device is capable of further generating a sound which provides user-preferred sound.

Moreover, for example, it may be that a user interface for receiving an input of the vocal clarity and the surround sound perception from a user is further included.

With the above aspect, the coefficient determination unit is capable of determining the second coefficient by using the vocal clarity and the surround sound perception obtained from the user interface. In other words, the sound signal processing device is capable of obtaining the vocal clarity and the surround sound perception used for determining the second coefficient without communicating with an external device or the like, leading to a reduced communication amount.

Moreover, for example, it may be that the remover includes: a first signal generator which generates a difference signal indicating a difference between the first-channel sound signal and the second-channel sound signal; and a filter unit which generates the first output signal by removing, from the difference signal, a frequency component in the vocal bandwidth that is based on the first coefficient, and the surround sound processor includes: a second signal generator which generates a surround signal by adding the surround sound effect to the first output signal; and the amplifier which generates the second output signal by amplifying the surround signal at the amplification factor that is based on the second coefficient.

With the above aspect, the sound signal processing device, which includes the first signal generator, the filter unit, the second signal generator, and the amplifier, is capable of appropriately adding surround sound effects.

A sound signal processing method according to one aspect of the present disclosure includes: generating a first output signal based on a first-channel sound signal, a second-channel sound signal, and a first coefficient indicating a vocal bandwidth to be removed, the first output signal being a signal from which a vocal component has been removed; generating a second output signal by adding a surround sound effect to the first output signal; amplifying an input signal at an amplification factor that is based on a second coefficient, the amplifying being performed (i) before the generating of the first output signal, (ii) between the generating of the first output signal and the generating of the second output signal, (iii) as part of the generating of the first output signal, or (iv) as part of the generating of the second output signal; synthesizing the second output signal with one of the first-channel sound signal and the second-channel sound signal; synthesizing a signal that is the second output signal inverted with another one of the first-channel sound signal and the second-channel sound signal; and setting the first coefficient and the second coefficient. The setting includes setting the second coefficient such that the amplification factor used when the vocal bandwidth to be removed based on the first coefficient is a second bandwidth is greater than the amplification factor used when the vocal bandwidth to be removed based on the first coefficient is a first bandwidth, the second bandwidth being greater than the first bandwidth.

With the above aspect, the same advantageous effects as the sound signal processing device can be provided.

Hereinafter, embodiments will be specifically described with reference to the drawings.

Note that each of the embodiments described below shows a general or specific example. The numerical values, structural elements, the arrangement and connection of the structural elements, steps, the processing order of the steps, etc., indicated in the following embodiments are mere examples, and therefore do not intend to limit the claims. Among the structural elements in the following embodiments, the structural elements which are not recited in any of the independent claims are described as optional structural elements.

Note that the drawings are not necessarily precise illustrations. The same reference signs indicate the same structural elements in the drawings, and overlapping descriptions thereof are omitted or simplified.

Moreover, terms, such as "equal", "constant" or "same" representing a relation between the structural elements, a numerical value, and a numerical range are used in the present description. Such terms and range are each not representing only a strict meaning of the term or range, but implying that a substantially same range, e.g., a range that includes even a difference as small as a few percentage, is also included in the term or range.

Embodiment 1

1-1. Configuration of Sound Signal Processing Device

First, a configuration of a sound signal processing device according to the present embodiment will be described with reference to FIG. 1 and FIG. 2. FIG. 1 is a block diagram illustrating a functional configuration of sound signal processing device 1 according to Embodiment 1. Sound signal processing device 1 is a device which generates a signal for outputting sound with surround sound perception, based on an L-channel input signal (sound signal) and an R-channel input signal (sound signal). An audio device, in which sound signal processing device 1 is mounted, includes, for example, two loudspeakers which are an L-side loudspeaker and an R-side loudspeaker. The term "sound with surround sound perception" refers to such sound that a user (listener) who is listening to the sound is capable of experiencing sound with stereophonic perception, sound with depth perception, or sound with expansion perception.

As illustrated in FIG. 1, sound signal processing device 1 includes vocal remover 10, surround sound processor 20, user interface (UI) 30, coefficient determination unit 40, synthesizer 50, and inverter 60.

Vocal remover 10 removes vocal components included in an L-channel input signal and an R-channel input signal, based on the L-channel input signal and the R-channel input signal. Specifically, vocal remover 10 generates a vocal-removed signal from which the vocal components have been removed, based on the L-channel input signal, the R-channel input signal, and a filter coefficient indicating the vocal bandwidth to be removed. Specifically, vocal remover 10 generates a vocal-removed signal based on a difference signal between the L-channel input signal and the R-channel input signal and a filter coefficient indicating the vocal bandwidth to be removed. The vocal-removed signal is a signal generated by removing the vocal components from the difference signal. It can be said that vocal remover 10 performs a preprocess on the sound signal on which the surround signal process is to be performed by surround sound processor 20, so as to prevent unclear voice from being output due to addition of the stereophonic perception and the like to the vocal components.

The L-channel input signal is an example of a first-channel sound signal, the R-channel input signal is an example of a second-channel sound signal, and the vocal-removed signal is an example of a first sound signal. Vocal remover 10 is an example of a remover.

Vocal remover 10 includes difference signal generator 11 and filter unit 12.

Difference signal generator 11 receives the L-channel input signal and the R-channel input signal, and generates a difference signal which indicates a difference between the two input signals.

The difference signal is a signal indicating the difference between the L-channel input signal and the R-channel input signal. Difference signal generator 11 is an example of a first signal generator.

Here, the L-channel input signal and the R-channel input signal are sound signals for outputting stereo sound. The L-channel input signal is a sound signal including sound to be output from the L-side loudspeaker (voice and sound other than voice) and the R-channel input signal is a sound signal including sound to be output from the R-side loudspeaker (voice and sound other than voice). The vocal components (voice signal components) included in the L-channel input signal are almost the same as the vocal components included in the R-channel input signal. The components other than the vocal components included in the L-channel input signal and the R-channel input signal are signal components different between the L-channel input signal and the R-channel input signal.

Difference signal generator 11 obtains the difference between the L-channel input signal and the R-channel input signal so that the vocal components (center components) commonly included in the L-channel input signal and the R-channel input signal can be cancelled out. Accordingly, although the difference signal generated by difference signal generator 11 includes almost no vocal component, vocal components may remain in the difference signal depending on the content and the like. For example, in the case where a delay effect for intentionally delaying sound output timing has been applied to one of the L-channel input signal and the R-channel input signal, vocal components may be included in the difference signal.

Filter unit 12 receives the difference signal, and generates a vocal-removed signal by removing the vocal components included in the difference signal. Filter unit 12 generates the vocal-removed signal by removing, from the difference signal, the frequency components in the vocal bandwidth that is based on the filter coefficient determined by coefficient determination unit 40.

Filter unit 12 includes, for example, an infinite impulse response (IIR) filter, but the present disclosure is not limited to such an example. In the present embodiment, for example, filter unit 12 includes a high-pass filter (HPF), but filter unit 12 may include a low-pass filter (LPF) or include both a HPF and a LPF. In the case where a surround signal process is performed on low-frequency voice, for example, filter unit 12 may include a low-pass filter. Filter unit 12 may include any filter as long as vocal components can be removed from the difference signal. An example where filter unit 12 includes a HPF will be described below.

Filter unit 12 removes the vocal components at the cutoff frequency that is based on the filter coefficient determined by coefficient determination unit 40. As the cutoff frequency increases, the bandwidth of the vocal components to be removed increases. In other words, as the cutoff frequency increases, the intensity of the vocal-removed signal decreases. The frequency bandwidth of the vocal components ranges, for example, from 300 Hz to 2000 Hz approximately, but the present disclosure is not limited to such an example. The filter coefficient is an example of a first coefficient indicating the vocal bandwidth to be removed.

Vocal remover 10 is capable of generating a vocal-removed signal in which almost all of the vocal components have been removed by difference signal generator 11 and filter unit 12.

Surround sound processor 20 generates an adjusted signal by performing, on the vocal-removed signal output from vocal remover 10, a surround signal process and the like for adding surround sound effects. Surround sound processor 20 includes surround signal generator 21 and amplifier 22.

Surround signal generator 21 generates a surround signal by performing a surround signal process on the vocal-removed signal. It can be said that surround signal generator 21 generates a surround signal by adding surround sound effects to the vocal-removed signal. In the surround signal process, any known process may be performed as long as surround sound effects can be added to the vocal-removed signal. Surround signal generator 21 is an example of a second signal generator. The surround signal is an example of a second output signal.

Amplifier 22 amplifies the input signal by using a gain value (an example of an amplification factor) that is based on the amplification coefficient determined by coefficient determination unit 40. In the present embodiment, amplifier 22 is connected between surround signal generator 21 and synthesizer 50, so that amplifier 22 receives a surround signal, and amplifies the surround signal by using the gain value that is based on the amplification coefficient to generate an adjusted signal. It can be said that amplifier 22 adjusts the intensity of the surround signal to be synthesized with the L-channel input signal and the R-channel input signal. The intensity of the surround signal is an absolute amount (integral value) of the signal to which the surround sound effects have been added. It can be said that the intensity of the surround signal is the intensity of stereophonic perception, depth perception, or expansion perception of the sound which is other than the voice and which is output from an audio device.

Amplifier 22 amplifies the surround signal at the amplification factor that is based on the amplification coefficient determined by coefficient determination unit 40. Amplifier 22 adjusts the intensity of the surround signal by changing the gain value of the surround signal based on the amplification coefficient output from coefficient determination unit 40. As the gain value increases, the intensity of the surround signal increases.

As described above, in the present embodiment, surround sound processor 20 adds surround sound effects to the vocal-removed signal, and adjusts the intensity of the surround signal.

User interface 30 receives input related to sound signal processing from a user. User interface 30 obtains, for example, information related to user preferred sound quality, and outputs the obtained information to coefficient determination unit 40. In the present embodiment, user interface 30 receives input of vocal clarity. The vocal clarity indicates the level of clarity of voice. In the present embodiment, the vocal clarity indicates the clarity level of the voice in the sound output from the L-side loudspeaker and the R-side loudspeaker. The vocal clarity indicates the level which designates the user preferred sound quality in the voice. High vocal clarity means that, for example, voice can be clearly heard, that is, the voice is clear. Moreover, the vocal clarity is represented by a numerical value ranging from 0 to 100, but the present disclosure is not limited to such an example.

It is to be noted that user interface 30 is not essential in sound signal processing device 1.

Coefficient determination unit 40 determines the filter coefficient of filter unit 12 and the amplification coefficient of amplifier 22. In the present embodiment, coefficient determination unit 40 obtains the vocal clarity from user interface 30, and determines the filter coefficient and the amplification coefficient according to the obtained vocal clarity. Coefficient determination unit 40 determines the filter coefficient and the amplification coefficient in association with each other. Coefficient determination unit 40 is an example of a setting unit which sets the filter coefficient and the amplification coefficient.

For example, as the cutoff frequency (cutoff frequency of HPF) that is based on the filter coefficient increases, the absolute amount of the vocal-removed signal decreases, resulting in a decrease in the intensity of the surround signal. Accordingly, coefficient determination unit 40 amplifies the intensity of the surround signal by increasing the gain value. When coefficient determination unit 40 determines the filter coefficient such that the cutoff frequency is a large value, coefficient determination unit 40 determines the amplification coefficient such that the gain value is a large value. In the case where, for example, the vocal bandwidth removed based on the filter coefficient is a second bandwidth that is greater than a first bandwidth, coefficient determination unit 40 determines the amplification coefficient such that the gain value at the time of the second bandwidth is greater than the gain value at the time of the first bandwidth. Coefficient determination unit 40 determines the second coefficient to be an amplification factor which cancels out the change in the intensity of the vocal-removed signal made by the filtering performed by filter unit 12.

Moreover, as the clarity level of the voice that is based on the vocal clarity increases, coefficient determination unit 40 determines the filter coefficient such that the cutoff frequency of the HPF increases, and sets the amplification coefficient such that the gain value of amplifier 22 increases.

The determination of the filter coefficient and the amplification coefficient by coefficient determination unit 40 will be described later. Coefficient determination unit 40 determines, for example, one set of a filter coefficient and an amplification coefficient for one piece of content. In other words, coefficient determination unit 40 does not change the filter coefficient and the amplification coefficient during content reproduction. Content is not particularly limited as long as the content includes sound information for outputting sound, and may be voice content or movie content.

Synthesizer 50 performs a process for putting the adjusted signal output from surround sound processor 20 back into the L-channel input signal and the R-channel input signal. Synthesizer 50 synthesizes the adjusted signal with the L-channel input signal and the R-channel input signal, and outputs the synthesized signals to the L-side loudspeaker and the R-side loudspeaker. Synthesizer 50 includes first synthesizer 51 and second synthesizer 52. Each of first synthesizer 51 and second synthesizer 52 is, for example, an adder.

First synthesizer 51 generates an L-side synthesized signal by synthesizing the adjusted signal with the L-channel input signal. The L-side synthesized signal is, for example, a signal of the sum of the L-channel input signal and the adjusted signal. First synthesizer 51 outputs the L-side synthesized signal to the L-side loudspeaker. The L-side synthesized signal is an example of a first synthesized signal.

Second synthesizer 52 generates the R-side synthesized signal by synthesizing the adjusted signal inverted by inverter 60 with the R-channel input signal. The R-side synthesized signal is, for example, a signal of the sum of the R-channel input signal and the inverted adjusted signal. Second synthesizer 52 outputs the R-side synthesized signal to the R-side loudspeaker. The R-side synthesized signal is an example of a second synthesized signal.

Inverter 60 inverts the input signal, and outputs the inverted signal. In the present embodiment, inverter 60 inverts the phase of the adjusted signal output from surround sound processor 20, and outputs the signal to second synthesizer 52. It can be said that inverter 60 performs a process for delaying the adjusted signal by a half cycle.

It may be that inverter 60 is connected between surround sound processor 20 and first synthesizer 51 or between surround sound processor 20 and second synthesizer 52. It is sufficient that inverter 60 is connected such that the phase of the adjusted signal input to either the L-channel input signal or the R-channel input signal can be inverted. It may be that inverter 60 inverts the phase of the adjusted signal output from surround sound processor 20, for example, and outputs the signal to first synthesizer 51.

It has been described that amplifier 22 is included in surround sound processor 20, but the present disclosure is not limited to such an example. For example, it may be that amplifier 22 is connected between vocal remover 10 and surround sound processor 20 to amplify the vocal-removed signal output from filter unit 12 and output the amplified signal to surround sound processor 20. Moreover, it may be that amplifier 22 is, for example, connected between difference signal generator 11 and filter unit 12 (amplifier 22 is included in vocal remover 10) to amplify the difference signal output from difference signal generator 11 and output the amplified signal to filter unit 12. Moreover, it may be that amplifier 22 is, for example, connected between difference signal generator 11 and a signal line transmitting the L-channel input signal and the R-channel input signal (connected upstream of vocal remover 10) to amplify the L-channel input signal and the R-channel input signal and output the amplified signals to difference signal generator 11. As described above, the position to which amplifier 22 is connected is not particularly limited.

In this case, amplifier 22 amplifies any one of the vocal-removed signal, the difference signal, the L-channel input signal, and the R-channel input signal. As a result of the amplification of these signals, the intensity of the surround signal is also amplified. In such a manner, amplifier 22 may indirectly adjust the intensity of the surround signal.

Although the hardware configuration of the structural elements of sound signal processing device 1 is not particularly limited, the hardware configuration may be a computer. Such a hardware configuration example will be described with reference to FIG. 2. FIG. 2 illustrates an example of a hardware configuration of computer 1000 in which the functions of sound signal processing device 1 according to the present embodiment are implemented by software.

Figure 2:
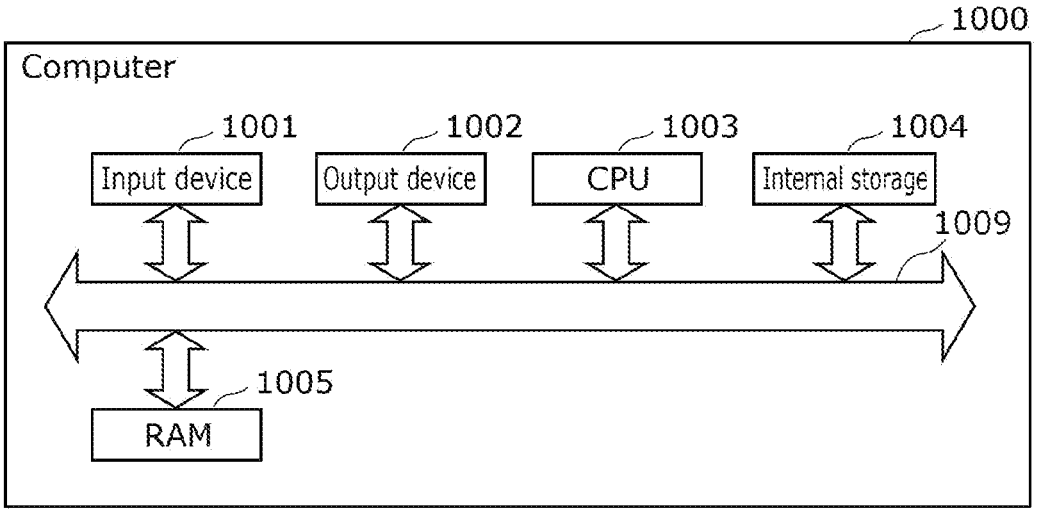
FIG. 2 illustrates an example of a hardware configuration of a computer that implements the functions of the sound signal processing device according to Embodiment 1 by software.

As illustrated in FIG. 2, computer 1000 is a computer which includes input device 1001, output device 1002, CPU 1003, internal storage 1004, RAM 1005, and bus 1009. Input device 1001, output device 1002, CPU 1003, internal storage 1004, and RAM 1005 are interconnected via bus 1009.

Input device 1001 is a device which serves as a user interface, such as an input button, touch pad, or touch panel display, and receives an operation performed by a user. Input device 1001 may be configured to receive an operation by voice, and a remote operation by a remote controller or the like, in addition to receiving a user contact operation. Input device 1001 corresponds to, for example, user interface 30 illustrated in FIG. 1. Input device 1001 corresponds to, for example, a device which inputs the L-channel input signal and the R-channel input signal illustrated in FIG. 1.

Output device 1002 is a device which outputs a signal from computer 1000. Output device 1002 may be a device which serves as a user interface such as a loudspeaker or a display, in addition to a signal output terminal. Output device 1002 corresponds to a device which outputs the L-side synthesized signal and the R-side synthesized signal illustrated in FIG. 1. Output device 1002 may also include loudspeakers corresponding to the L-side loudspeaker and the R-side loudspeaker illustrated in FIG. 1.

Internal storage 1004 is, for example, a flash memory. At least one of a program for implementing the functions of sound signal processing device 1 and an application using the functional configuration of sound signal processing device 1 may be prestored in internal storage 1004.

RAM 1005 is a random access memory (RAM), and is used for storing data and the like when a program or an application is executed.

CPU 1003 is a central processing unit (CPU). CPU 1003 copies the program and the application stored in internal storage 1004 to RAM 1005, and sequentially reads, from RAM 1005, the commands included in the program and the application for execution.

Computer 1000 may process, for example, a first sound signal (for example, L-channel input signal) and a second sound signal (for example, R-channel input signal) which are formed of digital signals in the same manner as vocal remover 10, surround sound processor 20, and coefficient determination unit 40 according to the present embodiment.

1-2. Determination of Each Coefficient by Coefficient Determination Unit

Figure 3:
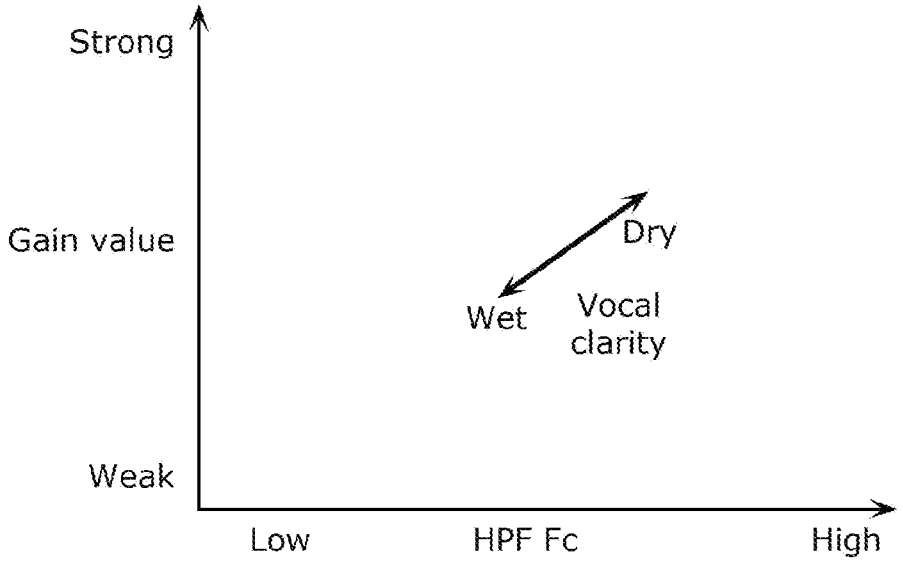
FIG. 3 illustrates a first example of a correlation between cutoff frequency and gain value for vocal clarity according to Embodiment 1.

Next, determination of each coefficient by coefficient determination unit 40 will be described with reference to FIG. 3 to FIG. 7. FIG. 3 illustrates a first example of a correlation between cutoff frequency (Fc) and gain value for vocal clarity according to the present embodiment. It can be said that FIG. 3 illustrates a correspondence between cutoff frequency (Fc) and gain value relative to vocal clarity value.

As illustrated in FIG. 3, the cutoff frequency and the gain value for vocal clarity value may have a linear correlation. In such a case, as the cutoff frequency increases, the gain value corresponding to the cutoff frequency also increases in proportion to the cutoff frequency. When a vocal clarity is obtained, the cutoff frequency and the gain value that are in accordance with the vocal clarity can be uniquely determined.

In FIG. 3, vocal clarity being Dry indicates that the vocal clarity is high (for example, close to 100), so that the cutoff frequency of the HPF is determined to be a high value, and accordingly, the gain value is also determined to a high value. Accordingly, when the intensity of the surround signal decreases due to the filtering by filter unit 12, the intensity of the surround signal can be increased by amplifier 22. Hence, when the filter coefficient which increases the vocal clarity is determined, the intensity of the surround signal is reduced, so that it is possible to prevent the surround sound perception from becoming weak.

In addition, in FIG. 3, the vocal clarity being Wet indicates that the vocal clarity is low (for example, close to 0), so that the cutoff frequency of the HPF is determined to be a low value, and accordingly, the gain value is also determined to be a low value.

Coefficient determination unit 40 determines a cutoff frequency and a gain value, for example, by using a formula indicating the correlation illustrated in FIG. 3. Coefficient determination unit 40 determines a cutoff frequency by calculation based on, for example, Formula 1 below.

$$Fc[Hz]=\text{vocal clarity}\times A+B \qquad \text{Formula (1)}$$

A indicates a slope and B indicates an intercept. Slope A and intercept B are appropriately determined according to the content and the like. For example, slope A may be 40, and intercept B may be 200.

Coefficient determination unit 40 determines the gain value by calculation based on, for example, Formula 2 below.

$$\text{Gain value[dB]}=(\text{Fc[Hz]})\times C+D \quad \text{Formula (2)}$$

C indicates a slope and D indicates an intercept. Slope C and intercept D are appropriately determined according to the content and the like. For example, slope C may be 1/350 and intercept D may be −10/7.

Figure 4:
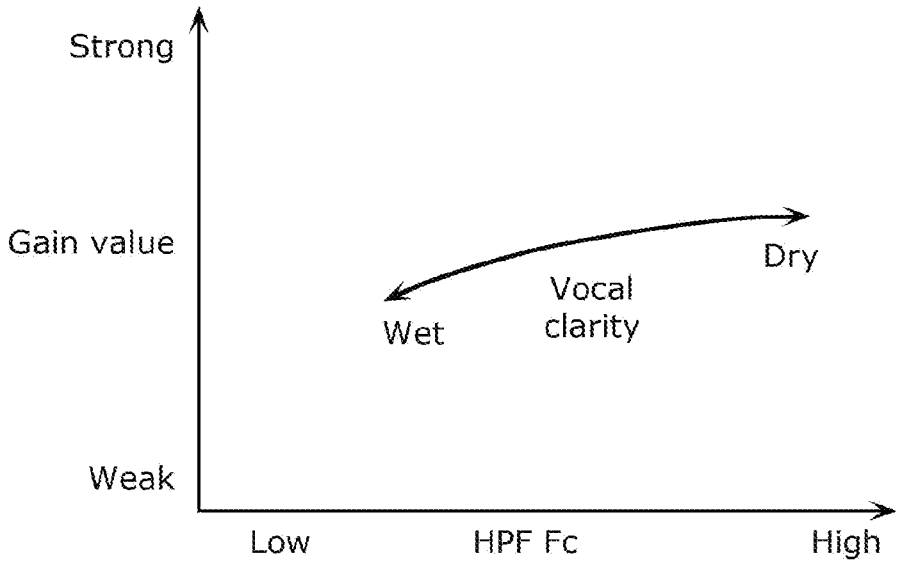
FIG. 4 illustrates a second example of the correlation between cutoff frequency and gain value for vocal clarity according to Embodiment 1.

The correlation is not limited to be linear. FIG. 4 illustrates a second example of the correlation between cutoff frequency (Fc) and gain value for vocal clarity according to the present embodiment.

As illustrated in FIG. 4, the cutoff frequency and the gain value for vocal clarity value may have a nonlinear correlation. The correlation may be represented by, for example, a convex upward function. The correlation between the cutoff frequency and the vocal clarity may be represented by, for example, an exponent function as indicated in Formula 3 below. With the above aspect, the change range of the clarity of the voice relative to the change range of the vocal clarity can be equalized. For example, the change range of voice clarity when vocal clarity is changed by a predetermined range in the low-frequency range can be equalized with the change range of voice clarity when vocal clarity is changed by a predetermined range in the high-frequency range.

$$\text{Fc[Hz]}=\text{EXP}(\text{vocal clarity}\times E)\times F \quad \text{Formula (3)}$$

E indicates a coefficient for calculating an exponentiation and F indicates an intercept. Coefficient E and intercept F are appropriately determined according to the content and the like. For example, coefficient E may be 0.03 and intercept F may be 200. The base in Formula 3 is, for example, a Napier's constant.

The correlation between cutoff frequency and gain value may be represented by, for example, a convex upward function. The correlation between cutoff frequency and gain value may be represented by, for example, a log function as indicated in Formula 4 below. With this, the vocal clarity can be changed while further keeping the surround sound perception constant. In other words, the cutoff frequency and the gain value that are in accordance with the vocal clarity can be determined while further keeping the surround sound perception constant.

$$\text{Gain value [dB]}=\ln(\text{Fc[Hz]})\times G+H \quad \text{Formula (4)}$$

G indicates a coefficient for calculating an antilog, and H indicates an intercept. Coefficient G and intercept H are appropriately determined according to the content and the like. For example, coefficient G may be 3.0686 and intercept H may be −18.327. The base in Formula 4 is, for example, a Napier's constant.

The surround sound perception indicates the surround sound effects subjectively perceived by the user. Strong surround sound perception indicates that the user is perceiving the surround sound effects strongly (for example, the user is experiencing strong sound stereophonic perception), whereas weak surround sound perception indicates that the user is perceiving little surround sound effects.

As illustrated in FIG. 3 and FIG. 4, vocal clarity may be represented by a monotonically increasing graph indicating cutoff frequency of filter unit 12 (for example, high-pass filter) on the horizontal axis and gain value of amplifier 22 on the vertical axis. Specifically, the monotonically increasing graph may be a logarithmic graph or a linear graph. Coefficient determination unit 40 is capable of determining the amplification coefficient in conjunction with the filter coefficient, by using the relations of the monotonically increasing graphs illustrated in FIG. 3 or FIG. 4. In other words, coefficient determination unit 40 is capable of determining the intensity of the surround signal in conjunction with the vocal bandwidth to be removed from the difference signal. It can also be said that coefficient determination unit 40 is capable of determining the intensity of the surround signal in conjunction with the amount of signal removed from the difference signal (for example, integrated value of signals removed).

Here, sensory experiments for deriving Formula 4 will be described with reference to FIG. 5 and FIG. 6. FIG. 5 illustrates results of sensory experiments on surround sound perception according to the present embodiment. FIG. 6 illustrates results of sensory experiments on vocal clarity according to the present embodiment.

The sensory experiments were conducted under the conditions of 132 patterns where the cutoff frequency of filter unit 12 was set to 200 Hz, 300 Hz, 400 Hz, 500 Hz, 800 Hz, 1000 Hz, 1500 Hz, 2000 Hz, 2500 Hz, 3000 Hz, and 4000 Hz, and the gain value of amplifier 22 at each cutoff frequency was varied from −5 dB to +6 dB by 1 dB. FIG. 5 illustrates the results in which surround sound perception was subjectively evaluated in each pattern, and FIG. 6 illustrates the results in which vocal clarity was subjectively evaluated in each pattern. In the experiments, Latin music was used as a sound source.

In FIG. 5, "×1" indicates the condition where surround sound perception was too strong, "Δ1" indicates the condition where surround sound perception was strong, "O" indicates the condition where surround sound perception was good, "Δ2" indicates the condition where surround sound perception was weak, and "×2" indicates the condition where no surround sound perception was felt (surround sound perception is too weak).

As illustrated in FIG. 5, surround sound perception tends to be weakly felt under the conditions where the gain value is low and the cutoff frequency is high, and surround sound perception tends to be strongly felt under the conditions where the gain value is high and the cutoff frequency is low.

In FIG. 6, "P" indicates the condition where vocal was heard clearly (the condition where voice was heard clearly), "Δ" indicates the condition where vocal was heard vaguely, and "×" indicates the condition where vocal was unclear. The term "vocal was heard vaguely" refers to that, for example, voice was vague to the extent that the meaning could be understood. The term "vocal was unclear" refers to that, for example, voice was vague to the extent that at least part of the meaning could not be understood.

As illustrated in FIG. 6, vocal clarity tends to be unclear under the conditions that the gain value is high and the cutoff frequency is low.

The conditions within the thick frames in FIG. 5 and FIG. 6 indicate the conditions where both surround sound perception and vocal clarity are "O". By coefficient determination unit 40 determining the filter coefficient and the amplification coefficient so as to obtain the cutoff frequency and the gain value within the thick frames, both vocal clarity and surround sound perception can be obtained.

Figure 7:
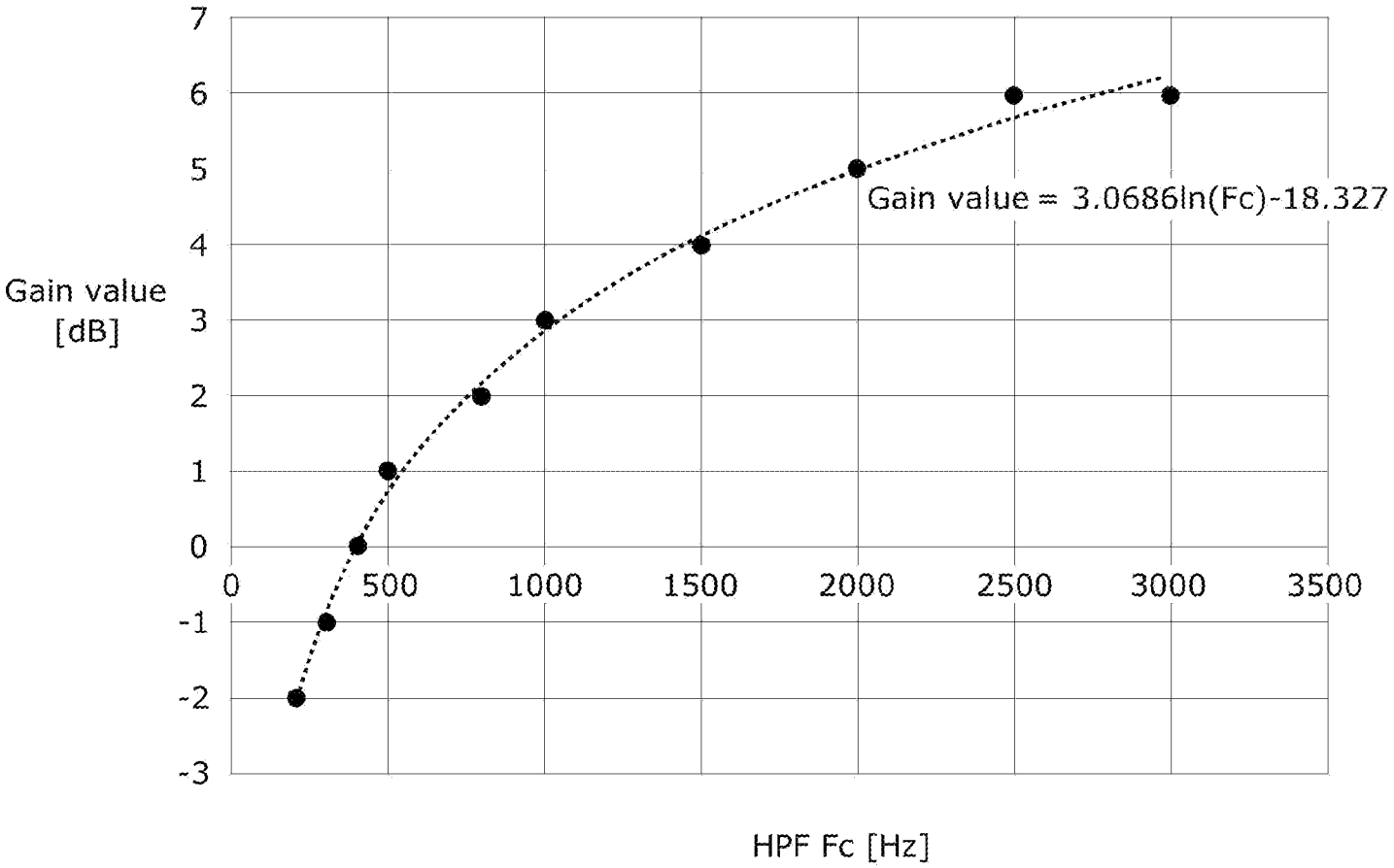
FIG. 7 illustrates a third example of the correlation between cutoff frequency and gain value for vocal clarity according to Embodiment 1.

In addition, FIG. 7 illustrates a plot of a set of cutoff frequency and gain value, for each cutoff frequency, where the same surround sound perception is felt even when the cutoff frequency is varied under the conditions in the thick frames. FIG. 7 illustrates a third example of the correlation between cutoff frequency and gain value for vocal clarity according to the present embodiment.

FIG. 7 illustrates a plot of the results where the gain value, which provides surround sound perception equal to the surround sound perception obtained at the cutoff frequency of 400 Hz, was evaluated at the respective frequencies other than 400 Hz, with the surround sound perception obtained when the cutoff frequency is 400 Hz and the gain value is 0 dB in FIG. 5 and FIG. 6 as a reference (hereinafter, also referred to as reference surround sound perception). For example, it is indicated that, at the cutoff frequency of 300 Hz, the surround sound perception at the gain value of −1 dB within the thick frame is felt similarly to the reference surround sound perception. In addition, for example, it is indicated that, at the cutoff frequency of 3000 Hz, the surround sound perception at the gain value of +6 dB within the thick frame is felt similarly to the reference surround sound perception. Note that the reference surround sound perception is not limited to the surround sound perception at the time of cutoff frequency of 400 Hz.

Here, when an approximate formula that is approximate to the plotted data string is calculated, Formula 5 below is given as in FIG. 7.

$$\text{Gain value [dB]} = 3.0686 \ln(Fc) - 18.327 \qquad \text{Formula (5)}$$

Formula 5 indicates a function where coefficient G in Formula 4 is 3.0686 and intercept H in Formula 4 is −18.327. Use of such an approximate formula allows the vocal clarity to be changed while keeping the surround sound perception more constant.

Formulae 1 to 5 described above are examples, and the present disclosure is not limited to such examples. For example, the approximate formula in Formula 5 is an example, and can vary according to the type of the sound source, user attribute (such as age or sex) or the like.

At least one of the formulae described above is prestored in the storage (for example, internal storage 1004 in FIG. 2) included in sound signal processing device 1.

1-3. Operation of Sound Signal Processing Device

Figure 8:
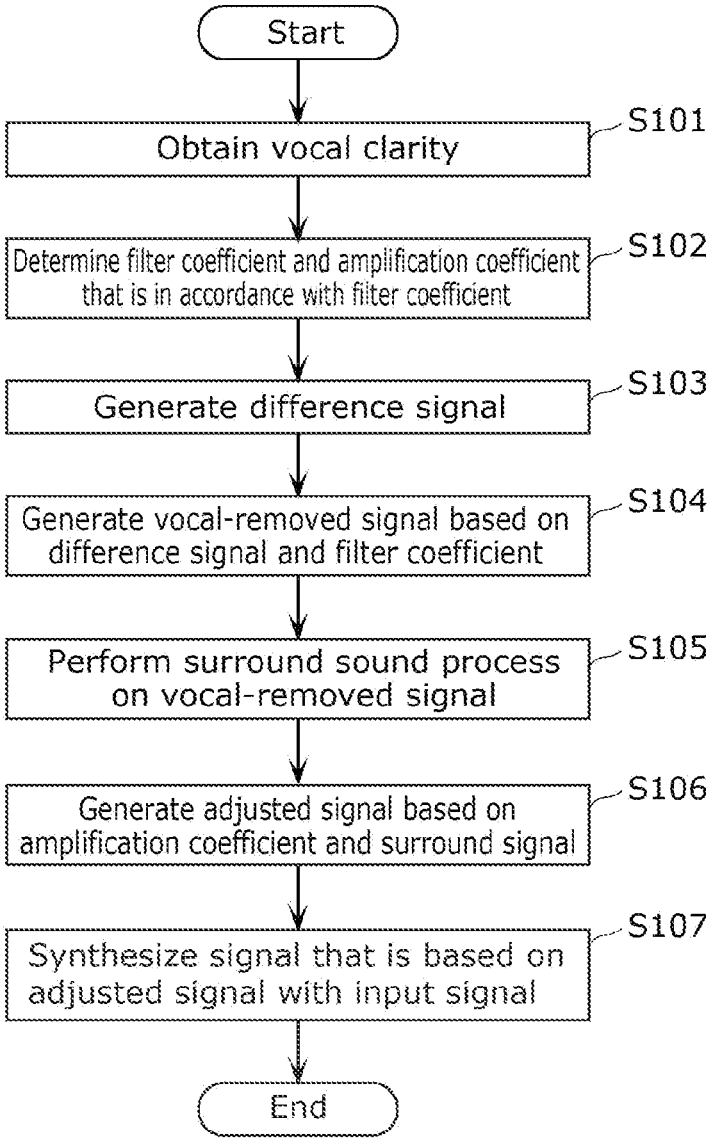
FIG. 8 is a flowchart of an operation of the sound signal processing device according to Embodiment 1.

Next, an operation of sound signal processing device 1 described above will be described with reference to FIG. 8. FIG. 8 is a flowchart of an operation of sound signal processing device 1 according to the present embodiment. In the following description, Formula 3 and Formula 4 are prestored in the storage included in sound signal processing device 1.

As illustrated in FIG. 8, user interface 30 obtains vocal clarity from the user (S101). User interface 30 obtains, for example, a numerical value ranging from 0 to 100 as the vocal clarity. The vocal clarity may be obtained when content is reproduced, or may be obtained in advance and stored in the storage (for example, internal storage 1004 illustrated in FIG. 2) included in sound signal processing device 1. User interface 30 outputs the obtained vocal clarity to coefficient determination unit 40.

User interface 30 may obtain a rank, such as "high", "medium", or "low", as the vocal clarity from the user, instead of obtaining the numerical value.

Next, coefficient determination unit 40 determines a filter coefficient and an amplification coefficient that is in accordance with the filter coefficient, based on vocal clarity (S102). Coefficient determination unit 40 reads Formula 3 from the storage, and substitutes vocal clarity to Formula 3 to calculate the cutoff frequency realizing the vocal clarity and determine the filter coefficient that is in accordance with the calculated cutoff frequency. Coefficient determination unit 40 reads Formula 4 from the storage, and substitutes the cutoff frequency corresponding to the determined filter coefficient into Formula 4 to calculate the gain value realizing desired surround sound perception, and determine the amplification coefficient that is in accordance with the calculated gain value, that is, the amplification coefficient that is in accordance with the filter coefficient. Coefficient determination unit 40 then outputs the determined filter coefficient to filter unit 12 and outputs the determined amplification coefficient to amplifier 22. Step S102 is an example of a setting step.

Next, difference signal generator 11 generates a difference signal that indicates the difference between the L-channel input signal and the R-channel input signal which have been input (S103). Difference signal generator 11 outputs the generated difference signal to filter unit 12.

Next, filter unit 12 generates a vocal-removed signal based on the difference signal and the filter coefficient (S104). Filter unit 12 generates the vocal-removed signal by extracting high-frequency components from the difference signal by using the cutoff frequency that is based on the filter coefficient. Filter unit 12 outputs the vocal-removed signal to surround signal generator 21. Step S104 is an example of a step of generating a first output signal.

Next, surround signal generator 21 performs a surround signal process on the vocal-removed signal (S105) to generate a surround signal. Surround signal generator 21 outputs the generated surround signal to amplifier 22. Step S105 is an example of a step of generating a second output signal.

Next, amplifier 22 generates an adjusted signal based on the amplification coefficient and the surround signal (S106). When the cutoff frequency is determined to be a large value, the intensity of the surround signal is low (the absolute amount of the surround signal is small). Accordingly, coefficient determination unit 40 determines the amplification coefficient such that the gain value is a large value. Accordingly, amplifier 22 is capable of increasing the intensity of the surround signal with the intensity which has been decreased by the filtering process performed by filter unit 12. Step S106 is an example of an amplifying step.

In such a manner, amplifier 22 adjusts the intensity of the signal to be synthesized with the L-channel input signal and the R-channel input signal. Amplifier 22 outputs the adjusted signal to synthesizer 50.

Next, synthesizer 50 synthesizes the signal that is based on the adjusted signal with the L-channel input signal and the R-channel input signal (S107). In the present embodiment, first synthesizer 51 generates the L-side synthesized signal by synthesizing the adjusted signal itself as the signal that is based on the adjusted signal with the L-channel input signal. Second synthesizer 52 generates the R-side synthesized signal by synthesizing the adjusted signal in which the phase is inverted by inverter 60 as the signal that is based on the adjusted signal with the R-channel input signal. First synthesizer 51 outputs the generated L-side synthesized signal to the L-side loudspeaker, and second synthesizer 52 outputs the generated R-side synthesized signal to the R-side loudspeaker. Step S107 is an example of a step of synthesizing the second output signal and a step of synthesizing a signal.

Accordingly, the signals output from sound signal processing device 1 to the L-side loudspeaker and the R-side loudspeaker have desired intensities of surround sound effects. In other words, the signals can provide desired surround sound perception. Hence, the audio device is capable of performing desired surround sound reproduction. The audio device is capable of outputting, for example, such a sound which allows the sound image to be localized in a region wider than the positions of the L-side loudspeaker and the R-side loudspeaker.

Embodiment 2

2-1. Configuration of Sound Signal Processing Device

Figure 9:
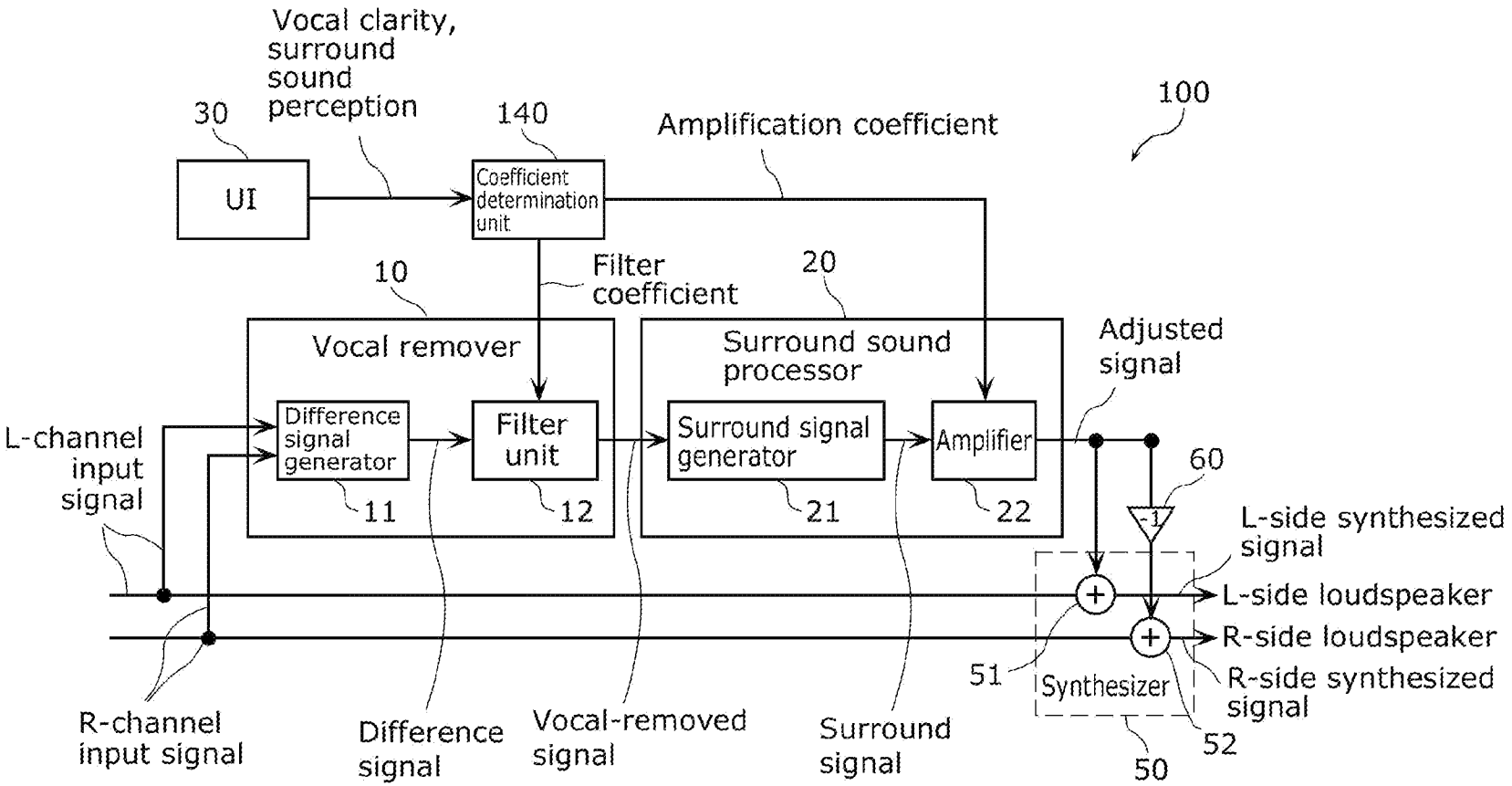
FIG. 9 is a block diagram illustrating a functional configuration of a sound signal processing device according to Embodiment 2.

First, a configuration of a sound signal processing device according to the present embodiment will be described with reference to FIG. 9. FIG. 9 is a block diagram illustrating a functional configuration of sound signal processing device 100 according to the present embodiment. Sound signal processing device 100 according to the present embodiment is different from sound signal processing device 1 according to Embodiment 1 mainly in that coefficient determination unit 140 further determines a filter coefficient and an amplification coefficient based on the surround sound perception as well. In the following description, sound signal processing device 100 according to the present embodiment will be described focusing mainly on the differences from sound signal processing device 1 according to Embodiment 1.

In the following description, the same reference signs are used for the structural elements which are identical or similar to those of sound signal processing device 1 according to Embodiment 1, and descriptions thereof will be omitted or simplified. The hardware configuration of the structural elements included in sound signal processing device 100 are not particularly limited, but may be the same as the hardware configuration of computer 1000 described in Embodiment 1 with reference to FIG. 2.

As illustrated in FIG. 9, sound signal processing device 100 includes coefficient determination unit 140 instead of coefficient determination unit 40 of sound signal processing device 1 according to Embodiment 1. User interface 30 receives input of surround sound perception from a user, in addition to vocal clarity. The surround sound perception is an example of a user preferred sound quality, and indicates the intensity of the user preferred surround sound effects, and is represented by a numerical value ranging from 0 to 100, for example. For example, surround sound perception being 100 or close to 100 indicates that the surround sound effects are strong (for example, the stereophonic perception, depth perception or expansion perception of the sound other than voice is strong). Moreover, surround sound perception being 0 or close to 0 indicates that the surround sound effects are weak (for example, the stereophonic perception, depth perception or expansion perception of the sound other than voice is weak). Note that the surround sound perception is not limited to be represented by numerical values.

Coefficient determination unit 140 determines the filter coefficient and the amplification coefficient according to the vocal clarity and the surround sound perception. Coefficient determination unit 140, for example, obtains the vocal clarity and the surround sound perception from user interface 30, determines the filter coefficient according to the obtained vocal clarity, and determines the amplification coefficient according to the obtained vocal clarity and surround sound perception.

2-2. Determination of Each Coefficient by Coefficient Determination Unit

Figure 10:
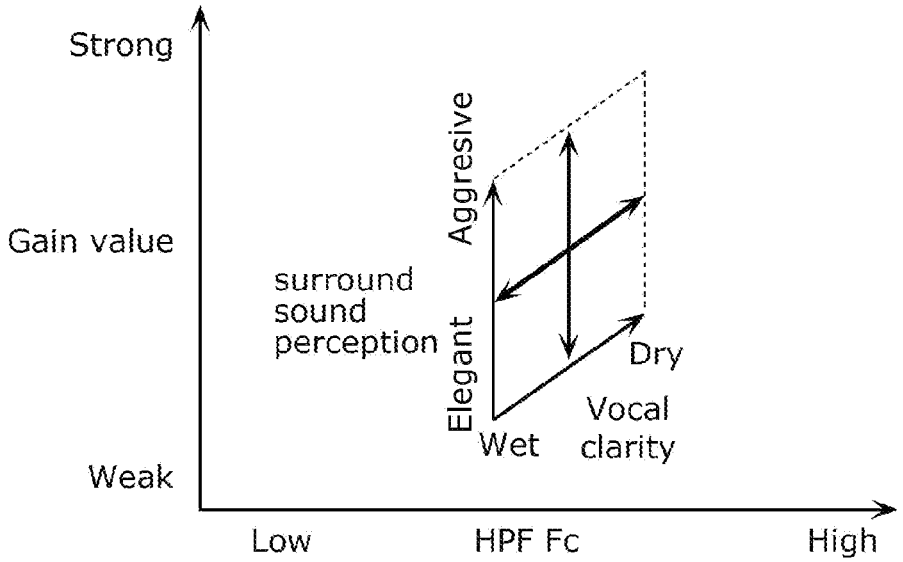
FIG. 10 illustrates a first example of a relation between cutoff frequency and gain value for vocal clarity and surround sound perception according to Embodiment 2.

Subsequently, determination of each coefficient by coefficient determination unit 140 will be described with reference to FIG. 10 and FIG. 11. FIG. 10 illustrates a first example of a relation between cutoff frequency and gain value for vocal clarity and surround sound perception according to the present embodiment. FIG. 10 illustrates a correspondence between cutoff frequency (Fc) and gain value relative to vocal clarity value, and a correspondence of a gain value relative to surround sound perception value.

As illustrated in FIG. 10, cutoff frequency and gain value have a linear correlation relative to vocal clarity, and a correlation parallel to the axis of the gain value relative to surround sound perception. In other words, the cutoff frequency is determined according to the vocal clarity, and the gain value is determined according to the vocal clarity and the surround sound perception. In other words, the surround sound perception is not used for determining the cutoff frequency.

Note that in FIG. 10, surround sound perception being Elegant indicates that the surround sound perception is low (for example, close to 0), and the gain value is determined to be a small value. In addition, the surround sound perception being Aggressive indicates that the surround sound perception is high (for example, close to 100), and the gain value is determined to be a large value.

Coefficient determination unit 140 may determine the cutoff frequency and the gain value, for example, by using the formula indicating the correlation in FIG. 10. Coefficient determination unit 140 may determine the gain value, for example, by calculation based on Formula 6 below. The formula used by coefficient determination unit 140 for calculating the cutoff frequency is the same as Formula 1 in Embodiment 1, and the description thereof will be omitted.

$$\text{Gain value [dB]}=(\text{Fc[Hz]})\times C+D+\text{surround sound perception}\times E+F \qquad \text{Formula (6)}$$

E indicates a slope relative to the surround sound perception, and F indicates an intercept relative to the surround sound perception. Slopes C and E and intercepts D and F are appropriately determined according to the content and the like. For example, slope C may be $1/350$, intercept D may be $-10/7$, slope E may be $1/25$, and intercept F may be $-2$. The intercept relative to the gain value can be calculated by adding intercepts D and F.

The correlation between cutoff frequency (Fc) and gain value for vocal clarity value is not limited to a linear shape. FIG. 11 illustrates a second example of the relation between cutoff frequency, and gain value for vocal clarity and surround sound perception according to the present embodiment.

Figure 11:
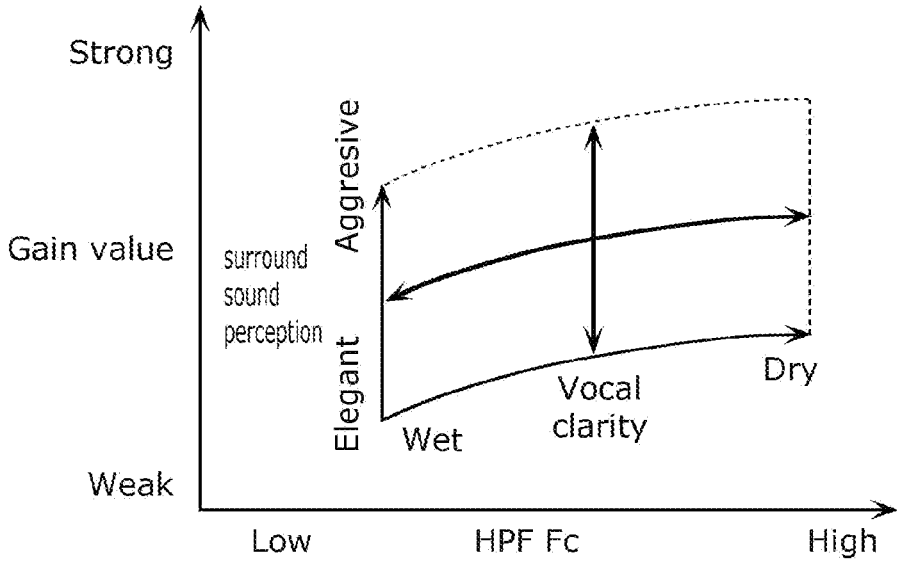
FIG. 11 illustrates a second example of the relation between cutoff frequency and gain value for vocal clarity and surround sound perception according to Embodiment 2.

As illustrated in FIG. 11, the cutoff frequency and the gain value may have a non-linear correlation relative to the vocal clarity. The correlation between cutoff frequency and gain value for vocal clarity may be represented by, for example, a convex upward function.

Coefficient determination unit 140 may determine the cutoff frequency and the gain value, for example, by using the formula indicating the correlation illustrated in FIG. 11. Coefficient determination unit 140 may determine the gain value, for example, by calculation based on Formula 7 below. The formula used by coefficient determination unit 140 for calculating the cutoff frequency is the same as Formula 3 in Embodiment 1, and thus, the description thereof will be omitted.

$$\text{Gain value [dB]}=\log(\text{Fc[Hz]})\times C+D+\text{surround sound perception}\times E+F \qquad \text{Formula (7)}$$

Slopes C and E and intercepts D and F are the same as those in Formula 6.

As illustrated in FIG. 10 and FIG. 11, surround sound perception may be represented by a graph which is parallel to the axis of the gain value and which indicates the cutoff frequency of filter unit 12 (high-pass filter) on the horizontal axis and the gain value of amplifier 22 on the vertical axis.

Coefficient determination unit 140 is capable of adjusting the surround sound perception to user preferred surround sound perception while keeping the vocal clarity constant, by determining the gain value by using Formula 7 and the cutoff frequency calculated in Formula 3. The amplification coefficient corresponding to the gain value thus determined is an example of an amplification coefficient determined according to the vocal clarity and the surround sound perception.

Other Embodiments

Although respective embodiments (hereinafter, also referred to as embodiments and the like) have been described above, the present disclosure is not limited to such embodiments and the like. Various modifications of the embodiments as well as embodiments resulting from arbitrary combinations of the structural elements of the embodiments that may be conceived by those skilled in the art are intended to be included within the scope of the present disclosure as long as these do not depart from the essence of the present disclosure.

For example, in each embodiment above, the example where the coefficient determination unit determines the filter coefficient and the amplification coefficient according to the vocal clarity obtained from the user interface or the vocal clarity and the surround sound perception has been described. However, the method of determining each coefficient is not limited to such an example. For example, it may be that a storage of the sound signal processing device stores sound source related information or user identification information and a table in which a filter coefficient and an amplification coefficient are associated with each other, and that the filter coefficient and the amplification coefficient corresponding to the obtained information are determined based on the currently obtained sound source information or the user identification information and the table. Examples of the sound source information include a sound source genre, and application of the sound source (for movie, for karaoke, etc.), but the present disclosure is not limited to such an example. The user identification information is information for identifying a user. In such a case, the filter coefficient and the amplification coefficient are associated with each other in the table such that the amplification coefficient increases as the filter coefficient increases.

Moreover, the example where Formulae 2, 4, and 6 in the embodiments above are formulae each indicating a correlation between cutoff frequency and gain value. However, the present disclosure is not limited to such an example, and may be a formula indicating a correlation between vocal clarity and gain value.

Moreover, the coefficient determination unit according to each embodiment above may determine the filter coefficient so as not to remove the components of the difference signal when vocal components are not included in the L-channel input signal and the R-channel input signal. In other words, the coefficient determination unit may determine the filter coefficient such that the difference signal passes the filters with no change. It may be that the coefficient determination unit obtains information about sound to be reproduced via a user interface or the like, determines whether or not the sound to be reproduced includes vocal components based on the obtained information, and determines the filter coefficient according to the determination result.

General and specific aspects of the present disclosure disclosed above may be implemented using a system, a device, a method, an integrated circuit, a computer program, or a computer-readable recording medium such as a CD-ROM, or any combination of systems, devices, methods, integrated circuits, computer programs, or computer-readable recording media.

Moreover, the processing order described with the flowcharts in the above embodiments and the like is an example. The processing order of plural steps may be changed, and may be performed in parallel.

Part of the structural elements included in the sound signal processing device may be configured by a single large scale integration (LSI) circuit. The system LSI is an ultra-multifunctional LSI manufactured by integrating a plurality of structural elements on a single chip, and specifically, is a computer system including a microprocessor, a ROM, a RAM and the like. A computer program is recorded in the RAM. The system LSI achieves its function by the microprocessor operating according to the computer program.

Part of the structural elements included in the sound signal processing device may be configured with an integrated circuit (IC) card that is removable from each device or a single module. The IC card or module is a computer system including a microprocessor, a ROM, a RAM and the like. The IC card or module may include the above-mentioned super-multifunctional LSI. The IC card or module achieves its function by the microprocessor operating according to the computer program. The IC card or module may be tamper resistant.

Part of the structural elements included in the sound signal processing device may be a computer-readable recording medium, such as a flexible disk, a hard disk, a CD-ROM, a MO, a DVD, a DVD-ROM, a DVD-RAM, a BD (Blu-ray (registered trademark) Disc), and a semiconductor memory, which can read the above computer program or the digital signal by a computer. Moreover, part of the structural elements included in the sound signal processing device may be the digital signal recorded on these recording media.

Part of the structural elements included in the sound signal processing device may transmit the above computer program or digital signal via an electronic communication line, a wireless or wired communication line, a network represented by the Internet, a data broadcast, or the like.

The present disclosure may be the method described above. Moreover, the method may be a computer program implemented by a computer or a digital signal configured from the computer program.

Moreover, the present disclosure may be a computer system including a microprocessor and a memory in which the memory records the computer program and the microprocessor operates in accordance with the computer program.

Alternatively, the program or the digital signal may be recorded on a recording medium and transferred, or the program or the digital signal may be transferred via a network or the like to be implemented by another independent computer system.

Moreover, respective embodiments may be combined.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure is applicable to, for example, an audio device which reproduces surround sound.

The invention claimed is:

1. A sound signal processing device, comprising:

a remover which generates a first output signal based on a first-channel sound signal, a second-channel sound signal, and a first coefficient indicating a vocal bandwidth to be removed, the first output signal being a signal from which a vocal component has been removed;

a surround sound processor which generates a second output signal by adding a surround sound effect to the first output signal;

an amplifier which amplifies an input signal at an amplification factor that is based on a second coefficient, the amplifier being (i) connected upstream of the remover, (ii) connected between the remover and the surround sound processor, (iii) included in the remover, or (iv) included in the surround sound processor;

a first synthesizer which synthesizes the second output signal with one of the first-channel sound signal and the second-channel sound signal;

a second synthesizer which synthesizes a signal that is the second output signal inverted with another one of the first-channel sound signal and the second-channel sound signal; and a setting unit which sets the first coefficient and the second coefficient, wherein the setting unit sets the second coefficient such that the amplification factor used when the vocal bandwidth to be removed based on the first coefficient is a second bandwidth is greater than the amplification factor used when the vocal bandwidth to be removed based on the first coefficient is a first bandwidth, the second bandwidth being greater than the first bandwidth.

2. The sound signal processing device according to claim 1, wherein the setting unit sets the first coefficient and the second coefficient according to a vocal clarity which indicates a level of clarity of voice that is based on synthesized signals generated by the first synthesizer and the second synthesizer.

3. The sound signal processing device according to claim 2, wherein the remover includes a high-pass filter, and the setting unit sets the first coefficient such that a cutoff frequency of the high-pass filter increases as the vocal clarity increases, and sets the second coefficient such that the amplification factor increases as the vocal clarity increases.

4. The sound signal processing device according to claim 2, wherein the remover includes a high-pass filter, the vocal clarity is represented by a monotonically increasing graph indicating a cutoff frequency of the high-pass filter on a horizontal axis and the amplification factor of the amplifier on a vertical axis, and the setting unit sets the first coefficient and the second coefficient based on the vocal clarity and the monotonically increasing graph.

5. The sound signal processing device according to claim 4, wherein the monotonically increasing graph is a logarithmic graph.

6. The sound signal processing device according to claim 4, wherein the monotonically increasing graph is a straight line graph.

7. The sound signal processing device according to claim 2, further comprising:

a user interface for receiving an input of the vocal clarity from a user.

8. The sound signal processing device according to claim 2, wherein the setting unit further sets the second coefficient according to a surround sound perception indicating a user preference for an addition of the surround sound effect.

9. The sound signal processing device according to claim 8, further comprising:

a user interface for receiving an input of the vocal clarity and the surround sound perception from a user.

10. The sound signal processing device according to claim 1, wherein the remover includes:

a first signal generator which generates a difference signal indicating a difference between the first-channel sound signal and the second-channel sound signal; and a filter unit which generates the first output signal by removing, from the difference signal, a frequency component in the vocal bandwidth that is based on the first coefficient, and the surround sound processor includes:

a second signal generator which generates a surround signal by adding the surround sound effect to the first output signal; and the amplifier which generates the second output signal by amplifying the surround signal at the amplification factor that is based on the second coefficient.

11. A sound signal processing method, comprising:

generating a first output signal based on a first-channel sound signal, a second-channel sound signal, and a first coefficient indicating a vocal bandwidth to be removed, the first output signal being a signal from which a vocal component has been removed;

generating a second output signal by adding a surround sound effect to the first output signal;

amplifying an input signal at an amplification factor that is based on a second coefficient, the amplifying being performed (i) before the generating of the first output signal, (ii) between the generating of the first output signal and the generating of the second output signal, (iii) as part of the generating of the first output signal, or (iv) as part of the generating of the second output signal;

synthesizing the second output signal with one of the first-channel sound signal and the second-channel sound signal;

synthesizing a signal that is the second output signal inverted with another one of the first-channel sound signal and the second-channel sound signal; and setting the first coefficient and the second coefficient, wherein the setting includes setting the second coefficient such that the amplification factor used when the vocal bandwidth to be removed based on the first coefficient is a second bandwidth is greater than the amplification factor used when the vocal bandwidth to be removed based on the first coefficient is a first bandwidth, the second bandwidth being greater than the first bandwidth.

* * * * *